US008807315B2

(12) United States Patent
Marchesini

(10) Patent No.: US 8,807,315 B2
(45) Date of Patent: Aug. 19, 2014

(54) DISCHARGE DEVICE

(71) Applicant: Wamgroup S.p.A., Modena (IT)

(72) Inventor: Vainer Marchesini, San Prospero (IT)

(73) Assignee: Wamgroup S.p.A., Modena (IT)

( * ) Notice: Subject to any disclaimer, the term of this patent is extended or adjusted under 35 U.S.C. 154(b) by 80 days.

(21) Appl. No.: 13/665,231

(22) Filed: Oct. 31, 2012

(65) Prior Publication Data

US 2014/0116837 A1 May 1, 2014

(51) Int. Cl.
*B65G 11/00* (2006.01)

(52) U.S. Cl.
USPC ..... 193/2 B; 193/2 A

(58) Field of Classification Search
USPC ..... 193/2 A, 2 R, 4, 28, 2 B
See application file for complete search history.

(56) References Cited

U.S. PATENT DOCUMENTS

| | | | | | |
|---|---|---|---|---|---|
| 2,965,250 | A * | 12/1960 | Johansson | 414/201 |
| 3,257,040 | A * | 6/1966 | Dumbaugh et al. | 222/161 |
| 3,722,747 | A * | 3/1973 | Petit | 222/56 |
| 4,095,723 | A * | 6/1978 | Lerner | 222/56 |
| 4,116,345 | A * | 9/1978 | Greaves et al. | 414/201 |
| 4,149,547 | A * | 4/1979 | Komossa et al. | 198/533 |
| 5,765,655 | A * | 6/1998 | Tatsuoka | 193/2 R |
| 6,493,605 | B1 * | 12/2002 | Prideaux et al. | 193/15 |
| 7,152,761 | B2 * | 12/2006 | Baker | 222/161 |

* cited by examiner

*Primary Examiner* — James R Bidwell
(74) *Attorney, Agent, or Firm* — Pearne & Gordon LLP

(57) ABSTRACT

A discharge device, preferably for a silo, comprising: an outer body (2), provided with an upper opening (21) and a lower opening (22); an inner body (3) positioned inside the first body (2); a plurality of arms (4), interposed between the outer body (2) and inner body (3) so as to connect the inner body (3) to the outer body (2). Each arm (4) is provided with a foot (5) endowed with at least one vibration damping portion (51) which has a resting surface on the outer body (2).

11 Claims, 3 Drawing Sheets

DISCHARGE DEVICE

FIELD OF THE INVENTION

The present invention relates to a discharge device, in particular for a silo.

DESCRIPTION OF RELATED ART

Silos of different shapes and sizes are broadly present in the market. In general, silos have a lower tapered portion that converges toward a lower discharge opening, through which the material—generally in granular or powder form—contained inside the silo can be withdrawn. Normally, at the discharge opening of the silo there is a discharge device designed to favour a fluid and continuous descent of the material contained inside the silo, when required.

The discharge devices of the known type generally comprise an outer hollow body, tapered in shape, which is associated with the silo at the bottom, in a position concentric to the discharge opening of the silo. The outer body has a lower opening, through which the material can be withdrawn, and an upper opening, through which the material coming from the silo enters the discharge device. Positioned inside the outer body there is an inner body, generally shaped like a cone with the apex turned downward, so that between the outer body and inner body there is defined a discharge conduit for the material. A vibrator device is associated with the outer body or inner body to favour the descent of the material along the discharge device.

The inner body is associated with and centred relative to the outer body by means of complex structures that are not adaptable to different configurations of the outer body and inner body. A typical example of such structures provides for the use of three or four rigid arms, in general arranged horizontally, which are interposed between the outer body and inner body and rigidly constrained to both. This type of connecting structure between the outer body and inner body is complicated to assemble. Furthermore, it does not allow the inner body or the outer body to be replaced with one of a different shape, unless all the arms present are replaced with arms suitable for the shapes adopted for the outer body and the inner body. The rigid constraint between the arms, outer body and inner body, moreover, does not enable the vibrations produced by the vibrator device to be properly absorbed, nor does it enable such vibrations to be evenly distributed over the outer body and inner body. It thus occurs with a certain frequency that the outer body and/or inner body become fractured in the areas where the arms are attached.

The object of the present invention is to offer a discharge device that enables the drawbacks of discharge devices of the known type to be overcome.

One advantage of the discharge device according to the present invention is that of being easy to install.

Another advantage of the device according to the present invention is that of being very flexible in its use, as it adapts to silos or other containers with discharge areas of different shapes and sizes.

A further advantage of the present invention is that of enabling an effective absorption and distribution of the vibrations produced by the vibrator device, preventing damage to the parts subjected to such vibrations.

BRIEF DESCRIPTION OF THE DRAWINGS

Additional features and advantages of the present invention will be more apparent from the approximate, and thus not limiting, description provided below of a preferred, but not exclusive, embodiment of the invention, with reference to the appended drawings, in which.

DETAILED DESCRIPTION OF PREFERRED EMBODIMENTS OF THE INVENTION

Figure 3:
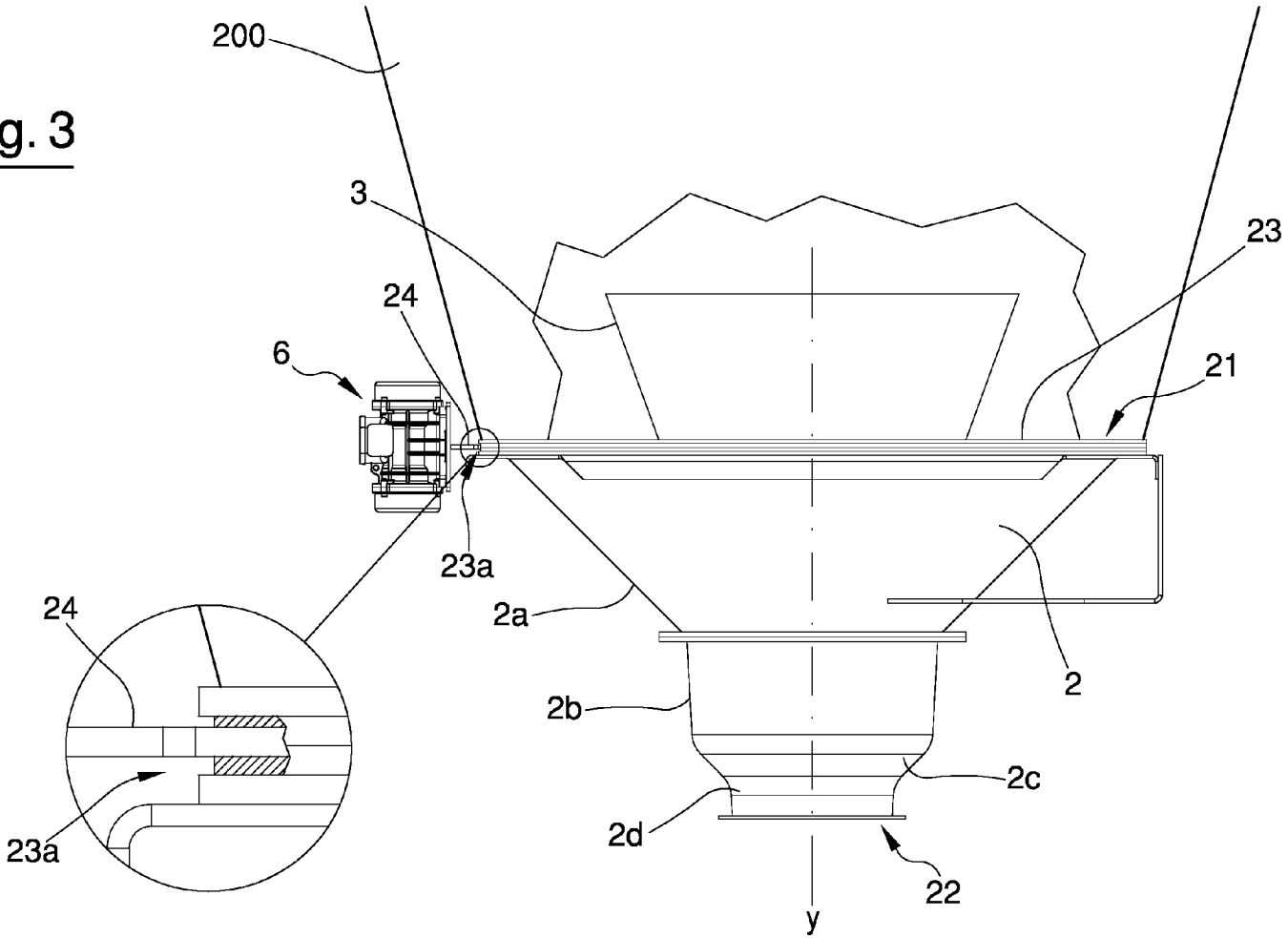
FIG. 3 shows a front view of the device of FIG. 1.

With reference to the above-mentioned figures, the discharge device according to the present invention comprises an outer body 2 that is hollow on the inside. The outer body 2 is provided with an upper opening 21 and a lower opening 22. The upper opening 21 is intended to face a discharge opening of a container 200 positioned above it, for example a silo or a hopper, so as to receive the material contained inside the container 200 itself. The lower opening 22, on the other hand, is intended to enable material to be discharged to the outside. A closing valve or door, not illustrated, can be placed on the lower opening 22 in order to regulate the discharge of material. Preferably, the outer body 2 has a cross section which decreases from the upper opening 21 to the lower opening 22. As can be seen in FIG. 3, the outer body 2 preferably has a first portion 2*a*, which extends from the upper opening 21, and has a conical shape with a larger angle of conicity. The first portion 2*a* is connected to a second portion 2*b*, likewise conical in shape, but with a smaller angle of conicity than the first portion 2*a*. Consecutively to the second portion 2*b*, there may be provided a third portion 2*c*, again conical, and having a larger angle of conicity than the second portion 2*b*. A terminal portion 2*d* is disposed consecutively to the third portion 2*c*. The changes in the conicity of the various portions of the outer body 2 favour the descent of the material, contributing to preventing the formation of loops inside the mass of descending material.

The outer body 2 has an attachment flange 23 at the top, configured to enable the device to be attached to an upper container 200. The attachment flange 23 is concentric to the upper opening 22 and preferably has a transverse through opening 23*a* whose function will be better clarified below.

Figure 1:
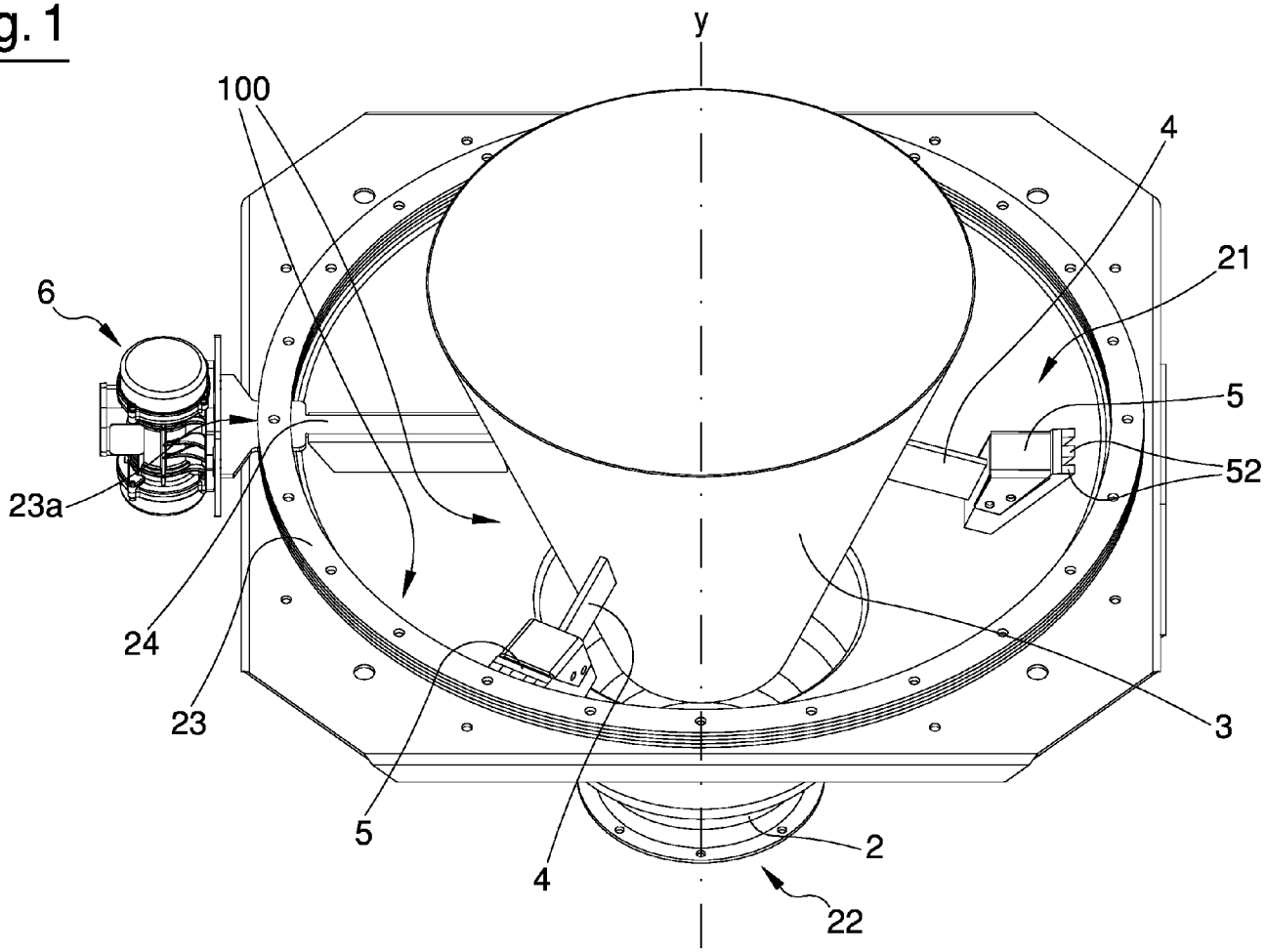
FIG. 1 shows a schematic perspective view of the device according to the present invention.
Figure 2:
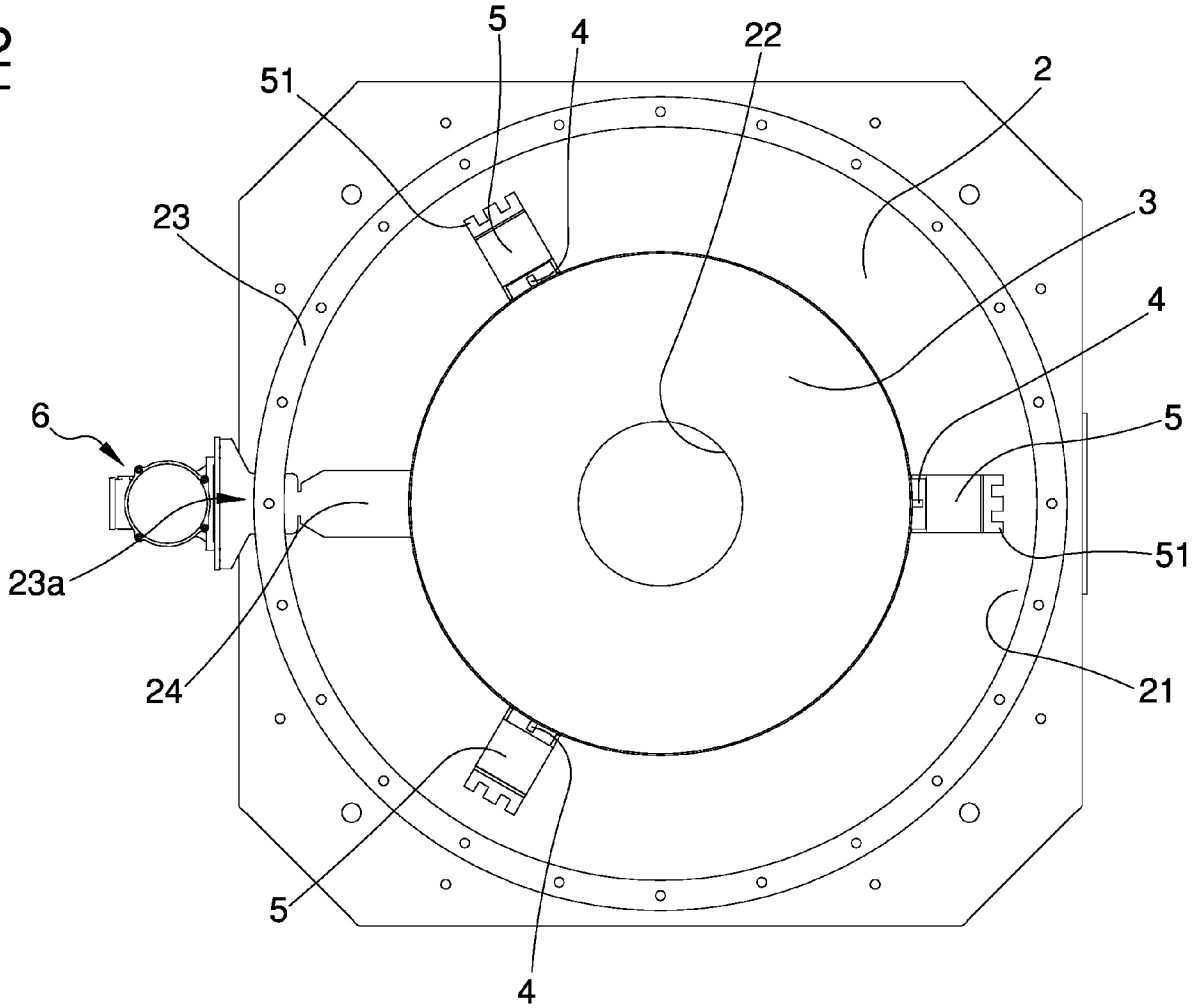
FIG. 2 shows a view from above of the device of FIG. 1.

The device further comprises an inner body 3 placed inside the outer body 2. Preferably the inner body 3 has a downward tapering conical shape. It is placed inside the outer body 2, preferably in a position that is concentric relative to the outer body 2 itself. As can be seen in FIGS. 1 and 2, between the outer body 2 and the inner body 3 there is defined a space that forms a discharge channel 100 for the material. This discharge channel 100 has an annular shape and extends substantially from the upper opening 21 of the outer body 2 to a lower end of the inner body 3. The inner body 3 is preferably hollow, so that the material can also flow through the inner body 3. The inner body 3 prevents the formation of loops inside the material, so that a fluid and continuous flow of the material itself is obtained.

A vibrator device 6 is associated with the inner body 3 in order to transmit the vibrations to the inner body 3 itself. A further vibrator device, not shown in the figures, could be associated with the outer body 2.

A plurality of arms 4 is interposed between the outer body 2 and the inner body 3 to connect the outer body 3 to the inner body 2. In a preferred, but not exclusive, embodiment of the device three arms 4 are present. The three arms are separated by angular pitches of about 120°, even if a different number of arms 4 could be provided. Each arm is associated with the inner body 3 and exhibits an inclination of about 90° relative to the outer surface of the inner body 3. Advantageously, each arm 4 is provided with a foot 5 endowed with at least one vibration damping portion 51, which has a resting surface on the outer body 2.

The inclination of the resting surface of the vibration damping portion 51 relative to the arm 4 is substantially equal to the inclination of the inner surface of the outer body 2 in the area intended to receive the vibration damping portion 51 itself resting upon it. This enables the inner body 3, provided with the arms 4 endowed with feet 5 with a vibration damping portion 51, to be simply rested upon the outer body 2, without the need for any additional support and/or centring and/or fastening structures. This considerably simplifies the assembly and the subsequent maintenance operations on the device, in the event that it is necessary to remove the inner body 3. Advantageously, each foot 5 could be associated with its own arm 4 via a joint rotating around at least one axis, preferably around a horizontal axis perpendicular to the arm 4 itself. This enables each foot 5 to adapt to the inclination of the wall of the outer body 2 in the area of the resting surface of the vibration damping portion. The joint of each foot 5 could be free, i.e. each foot 5 could rotate idly around its joint, or it could be adjustable, i.e. each foot 5 could be set in a given angular position by means of an adjustment device (not illustrated).

The vibration damping portion 51 enables the vibrations produced by the vibrator device 6 to be absorbed at least in part. The vibration damping portion 51 also enables the vibrations to be evenly distributed over the surface of the outer body 2, thus preventing the outer body 2 from undergoing damage or breakage in the area of the resting surface of the vibration damping portion 51 itself.

In a first example embodiment, which can be seen in FIGS. 1 and 2, the vibration damping portion 51 comprises at least two ribs 52 which define the resting surface on the first body 2. In particular, the embodiment shown in FIGS. 1 and 2 comprises three ribs 52. By concentrating the resting load on a smaller surface, the arrangement of at least two ribs 52 on the resting surface of the vibration damping portion 51 makes it possible to obtain a resting surface that overall is more adaptable to any localized deformations of the inner surface of the outer body 2. The ribs 52 moreover serve to improve the adherence to the inner surface of the outer body 2. In an alternative embodiment, the vibration damping portion 51 has a smooth resting surface on the first body 2. In both embodiments the vibration damping portion 51 is hollow on the inside. A hollow structure of the vibration damping portion 51 enables the absorption of vibrations to be increased.

Preferably, the arms 4 have the possibility of varying their longitudinal extension. For this purpose, the arms 4 have a telescopic structure. The possibility of varying the longitudinal extension of the arms 4 makes the device extremely flexible. It is in fact possible to vary the shape of the outer body 2, by modifying, for example, its angle of conicity and/or diameter in the area of contact with the vibration damping portion 51, since each vibration damping portion 51 could be made to rest correctly by varying the length of the corresponding arm 4. It is also possible to vary the position of the inner body 3 along the longitudinal axis Y, simply by varying the length of the arms 4.

Preferably, the vibration damping portion 51 is made of elastomeric material, which offers excellent properties of vibration absorption combined with a low coefficient of friction.

As mentioned previously, the device according to the present invention comprises a vibrator device 6 associated with the inner body 3. The association between the vibrator device 6 and the inner body 3 can be achieved by means of a rod 24. The rod 24 can be directly connected to the inner body 3.

As mentioned previously, the attachment flange 23 has a transverse through opening 23*a*. The opening 23*a* is useful for accommodating the rod 24 which connects the vibrator device 6 to one of the arms 4. The presence of the opening 23*a* is particularly advantageous since it makes it possible to avoid drilling a hole in the outer body 2 and considerably facilitates installation and removal of the vibrator device 6.

The invention claimed is:

1. A discharge device, preferably for a silo, comprising: an outer body (2), provided with an upper opening (21) and a lower opening (22); an inner body (3) positioned inside the first body (2); a plurality of arms (4), interposed between the outer body (2) and inner body (3) so as to associate the inner body (3) with outer body (2); characterized in that each arm (4) is provided with a foot (5) endowed with at least one vibration damping portion (51) which has a resting surface on the outer body (2).

2. The discharge device according to claim 1, wherein said arms (4) have the possibility of varying their longitudinal extension.

3. The device according to claim 2, wherein said arms (4) have a telescopic structure.

4. The discharge device according to claim 1, wherein said vibration damping portion (51) comprises at least two ribs (52) which define the resting surface on the outer body (2).

5. The discharge device according to claim 1, wherein said vibration damping portion (51) has a smooth resting surface on the outer body (2).

6. The device according to claim 1, wherein said vibration damping portion (51) is hollow on the inside.

7. The device according to claim 1, wherein said vibration damping portion (51) is made of elastomeric material.

8. The device according to claim 1, comprising a vibrator device (6) associated with the inner body (3).

9. The device according to claim 1, wherein the inner body (3) has a downward tapering conical shape.

10. The device according to claim 1, wherein the outer body (2) has an attachment flange (23) at the top, configured to enable the device to be attached to an upper container (200).

11. The device according to claim 10, wherein said attachment flange (23) has a transverse through opening (23*a*) configured to accommodate a rod (24) which connects a vibrator device (6) to the inner body (3).

* * * * *